United States Patent [19]

Ekman

[11] 4,252,213

[45] Feb. 24, 1981

[54] LIFTING SYSTEM CONTROL DEVICE

[76] Inventor: Jan Ekman, Älgstigen 32, 814 00 Skutskär, Sweden

[21] Appl. No.: 99,406

[22] Filed: Dec. 3, 1979

[30] Foreign Application Priority Data

Dec. 15, 1978 [SE] Sweden ..... 7812914

[51] Int. Cl.[3] ..... B66F 11/04

[52] U.S. Cl. ..... 182/2; 182/19

[58] Field of Search ..... 182/19, 2, 141, 148

[56] References Cited

U.S. PATENT DOCUMENTS

| | | | |
|---|---|---|---|
| 4,160,492 | 7/1979 | Johnston | 182/2 |
| 4,187,927 | 2/1980 | Byrne | 182/2 |

*Primary Examiner*—Reinaldo P. Machado

*Attorney, Agent, or Firm*—Silverman, Cass & Singer, Ltd.

[57] ABSTRACT

A device for controlling a lifting system, for example a so-called sky-lift, a building construction machine or the like, where the lifting system comprises at least one articulated arm (5,10,11), a working unit (15) such as a loading platform, hydraulic cylinders (6,12,13,16) intended to act on the same (5,10,11,15), necessary valves for said cylinders (6,12,13,16) and means for controlling said valves.

The invention is characterized in that it comprises position sensing members (17,18) capable to deliver to a control unit (19) actual values, which geometrically determine the lifting system, annd a control panel (20) capable to deliver nominal values to said control unit (19).

The control unit (19) is capable to compare actual values with nominal values and to act on adjusting means (22) for said valves so as to cause said working unit (15) to carry out a predetermined movement.

According to a preferred embodiment, the control unit (19) is a so-called programmable micro-computer, which is programmed and arranged in a suitable way.

7 Claims, 2 Drawing Figures

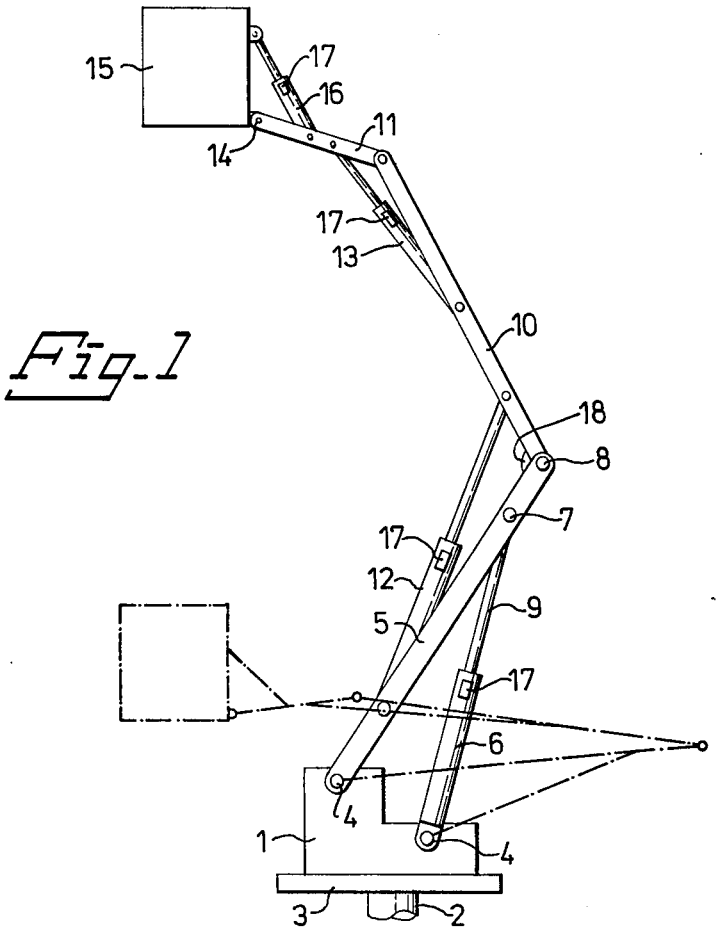
Fig. 1
Fig. 2
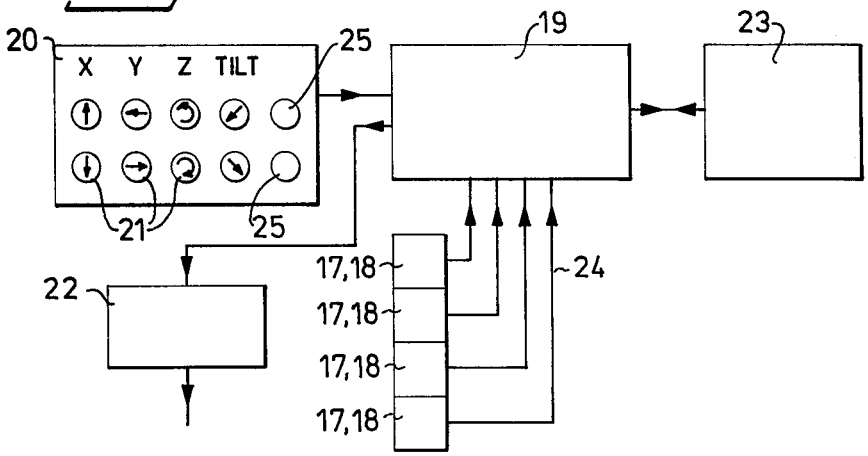

LIFTING SYSTEM CONTROL DEVICE

This invention relates to a device for controlling lifting systems, which comprise at least two hydraulic cylinders with necessary valves.

Hydraulic lifting systems, for example for sky-lifts and construction machines, often are assembled in principle of articulated arms and hydraulic cylinders acting on said arms. Normally one cylinder acts on every articulated arm, and the cylinder is capable to turn the arm about an attachment point, for example at one end of the arm.

The lifting system often is assembled of articulated arms, which are connected hingedly end to end, in such a manner, that a first arm and a cylinder acting thereon are attached to a fixed point of some kind, for example a car. A second arm is attached to the free end of the first arm, and a second cylinder acting on the second arm is attached to the first arm, a.s.o.

At the free end of the "last" articulated arm of the system a "working" unit is provided, for example a cage to be manned, a bucket or loading platform.

To-day, systems of this kind are so operated that every cylinder and therewith also the joints are controlled separately by means of necessary valves and actuating means therefor. The operation in this way of the system is tedious, and to some extent unsafe and riskful, because the operation must be carried out in steps for every cylinder, with a certain sequence between the cylinders.

The "working" unit often is required to assume a certain position, irrespective of how the system in general is or has been adjusted. A manned cage, for example, must not be inclined too much, a loading platform must be maintained horizontal, etc.

This problem can be solved by means of tie rods, but for equipment of the kind here concerned this solution is relatively expensive.

The present invention has the object to produce a device for controlling hydraulic lifting systems which eliminates the aforesaid problems at relatively low cost.

The present invention relates to a device for controlling a lifting system, for example a so-called sky-lift, a construction machine or the like, which system comprises at least one articulated arm, one working unit such as a loading platform or the like, hydraulic cylinders to act thereon, necessary valves for said cylinders and means for controlling said valves.

The invention is characterized in that position-sensing members are provided to deliver to a control unit actual values, which geometrically determine the lifting system, and a control panel is provided to deliver to said control unit nominal values, which control unit is capable to compare said actual values with said nominal values and to act on adjusting means for said valves so as to cause said working unit to carry out a predetermined movement.

The invention is described in the following, with reference to the accompanying drawing, in which FIG. 1 shows an embodiment of a lifting system, to which the present invention is intended to be applied, FIG. 2 shows a schematically drawn device according to the invention for controlling the lifting system according to FIG. 1.

In FIG. 1 an operating position of the lifting system is indicated by fully drawn lines, and an imagined non-operating or transport position is indicated by dash-dotted lines. In FIG. 1 the numeral 1 designates a base, on which a lifting system is attached. The base can be turned in a horizontal plane by means of a vertical axle 2, which in a suitable way is attached to the lower surface 3 of the base 1. The base 1 is intended to be mounted on, for example, a vehicle (not shown in FIG. 1).

A hinged arm 5 and a hydraulic cylinder 6 are in definitely spaced relationship attached to the base 1 by means of suitably designed joints 4, so that the hinged arm 5 and the cylinder 6 can be turned about the joints 4 in a vertical plane.

The piston rod 9 of the cylinder 6 is attached to the arm 5 by means of a joint 7 of suitable kind at a definite distance from the upper end 8 of the arm 5 in FIG. 1. The cylinder 6, thus, is so arranged to the arm 5 that the arm 5 can be turned by the cylinder 6 about the joint 4.

Two further hinged arms 10 and 11 are attached by means of joints to the arm 5 "in a row" from the upper end 8 of the arm 5.

A hydraulic cylinder 12 is hingedly attached to the arm 5 and the arm 10 and, thus, by its piston rod acts on the arm 10. A hydraulic cylinder 13 is hingedly attached in a corresponding way to the arm 10 and the arm 11 and acts on the arm 11. A working unit 15 is hingedly attached at its lower portion 14 to the free end of the arm 11. Said unit is here by way of example designed as a cage to be manned. A hydraulic cylinder 16 is provided between the arm 11 and the cage 15 in a corresponding manner as described above and, thus, acts on the cage 15.

Valves for actuating the cylinders 6,12,13,16 and conduits for oil supply are provided but not shown in FIG. 1.

Each of the cylinders 6,12,13,16 is provided with position-sensing members, viz. position transmitters 17, which are capable to indicate the position of each cylinder, i.e. in principle to indicate the position which the piston rod assumes in relation to the cylinder portion containing oil. In FIG. 1 the transmitters are only marked. The system of hinged arms and cylinders is geometrically determined, which implies that the position of the cage 15 is known when the settings of the cylinders 6,12,13,16 are known. The transmitters 17 are capable to deliver actual values for the setting of the cylinders in a suitable manner, for example in the form of electric signals. At an alternative embodiment, the position-sensing members are angle transmitters 18 located in connection to the points, in which the hinged arms 5,10,11 are hingedly attached, and to the point, in which the cage 15 is hingedly attached to the hinged arm 11. Angle transmitters have been shown only in one place in FIG. 1. By means of the angle transmitters 18, which indicate the inclination of the arms 5,10,11 to a definite reference, information on the position of the cage 15 can be obtained due to the geometric definiteness of the system. Also in this case the transmitters are capable to deliver actual values.

In FIG. 2 the numeral 19 designates a control unit, preferably a so-called micro-computer. 20 designates a control panel with a plurality of control keys 21. 22 designates an adjusting means, and 23 designates a memory adapted to the control unit 19.

The position transmitters 17, indicated schematically in FIG. 2, are capable to transmit actual values for the setting of the cylinders via electric lines 24 to the control unit 19, in which the actual values are intended to be processed.

The control panel 20 is provided with control keys 21 of suitable kind, which refer to desired changes in the position of the cage 15. In FIG. 2 these position changes are indicated by arrows. The desired changes in position here have been assumed to be rectilinear vertical, rectilinear horizontal, rotation about the axle 2 and tilting of the cage 15. In FIG. 2 also control keys 25 for special functions are marked. The control panel 20 is capable to deliver to the control unit 19 nominal values containing information on desired position changes.

The control unit 19, which preferably is a micro-computer, is arranged and programmed to compare in known manner actual values with nominal values and to give control signals to the adjusting means 22, which is capable by means of electric signals to actuate the valves, which control the setting of the cylinders 6,12,13,16 so that the desired adjustment of the system is obtained.

The memory 23 is adapted to the control unit 19 and arranged so, that signals produced by the control unit and corresponding to a definite adjustment or setting of the lifting system are registered in the memory and can be repeated upon signal from the control panel 20.

The mode of operation of the device according to the present invention substantially has become apparent from above. The desired adjustment of the system is selected by means of control keys 21,25 on the control panel 20. From the control panel a nominal value in form of a signal is transferred to the control unit 19, in which nominal values are compared with actual values, which indicate the actual setting of the lifting system. The actual values originate from measuring values obtained from transmitters attached in the lifting system as described above. From the control unit signals containing information based on said comparison are transferred to the adjusting means 22, which actuate the valves controlling the setting of the cylinders 6,12,13,16.

By choosing a suitable control unit, such as a programmable micro-computer as here preferably chosen, great possibilities exist to program in the control system desired and suitable functions.

The micro-computer thus is programmed so that the working unit can be moved in predetermined rectilinear paths, for example horizontally and vertically.

According to the embodiment the micro-computer also is programmed so that the working unit always forms a definite angle with, for example, the horizontal plane, irrespective of how the lifting system in general is adjusted. It is, thus, possible so to program the computer that a loading platform always is horizontal, irrespective of how it is moved.

According to a further embodiment, the computer is programmed so that fixed functions are carried out partially by means of the memory. When the lifting system is mounted on a vehicle and intended for repair work above ground level, for example for exchanging used-up street lamps, all of which are located on the same level above the ground, the setting of the system made "manually" when the first lamp is changed is memorized by means of the memory. Thereafter, when the next lamp is to be exchanged or the vehicle is to be moved, this setting is re-called and resumed by means of a special control key on the control panel. When a corresponding lifting system is used, for example, for cleaning a plurality of windows located symmetrically from the front wall side of a house, the fixed steps between windows and rows of windows can be memorized and thereafter run through automatically.

A great number of applications of this kind are possible. A device according to the invention, as appears from above, is a solution of the problems involved with the control of lifting systems of the kind here concerned.

The need of parallel tie rod structures, for example, is eliminated. Such structures, which are expensive, are utilized as mentioned when some part of the system is to form a definite angle with some reference, irrespective of how the system in general is adjusted. One example is a loading plane, which is desired to be always horizontal. The parallel tie rod in such structures advantageously can be replaced by a cylinder when a device according to the present invention is used.

As mentioned, several modified embodiments of a device according to the invention, of course, can be imagined. The invention, thus, must not be regarded restricted to the embodiments described above, but can be varied within the scope defined by the accompanying claims.

I claim:

1. A device for controlling a lifting system, for example a so-called sky-lift, a building construction machine or the like, which lifting system comprises at least one articulated arm, a working unit such as a loading platform or the like, hydraulic cylinders intended to act thereon, necessary valves for said cylinders and means for controlling said valves, characterized in that position-sensing members (17,18) are provided to deliver to a control unit (19) actual values, which geometrically determine the lifting system, and a control panel (20) is provided to deliver to said control unit (19) nominal values, which control unit (19) is capable to compare said actual values with said nominal values, and to act on adjusting means (22) for said valves so as to cause said working unit (15) to carry out a predetermined movement.

2. A device as defined in claim 1, characterized in that said control unit (19) is a programmable so-called micro-computer, which is programmed in a suitable way and capable to transmit signals to said adjusting means (22), which is capable to electrically control said valves in a way indicated by signals from the micro-computer.

3. A device as defined in claim 1, characterized in that said position-sensing means (17) are located in connection to said cylinders (6,12,13,16) and consist of position-transmitters (17) of known kind, which sense the setting of the cylinders (6,12,13,16).

4. A device as defined in claim 1, characterized in that said position-sensing means (18) are located in connection to the hinged arm/hinged arms (5,10,11) and consist of angle transmitters (18) of known kind, which sense the inclination of the hinged arm/hinged arms (5,10,11) to a definite reference.

5. A device as defined in claim 2, characterized in that it comprises a memory (23) so connected to said control unit (19), that signals produced by the control unit (19) and corresponding to a definite setting for the lifting system are registered in the memory (23) and upon signal from said control panel (20) can be returned to the control unit (19).

6. A device as defined in claim 2, characterized in that said control unit (19) is so arranged and programmed that, irrespective of adjustment of the lifting system, said working unit (15) forms a predetermined angle with the horizontal plane.

7. A device as defined in claim 2, characterized in that said control unit (19) is so arranged and programmed that said working unit (15) is moved in a predetermined rectilinear path.

* * * * *